US008071515B2

(12) United States Patent
Kamano et al.

(10) Patent No.: US 8,071,515 B2
(45) Date of Patent: Dec. 6, 2011

(54) LUBRICATING OIL COMPOSITION

(75) Inventors: Hideki Kamano, Ichihara (JP); Kazuhiro Teshima, Ichihara (JP)

(73) Assignee: Idemitsu Kosan Co., Ltd., Tokyo (JP)

( * ) Notice: Subject to any disclaimer, the term of this patent is extended or adjusted under 35 U.S.C. 154(b) by 93 days.

(21) Appl. No.: 12/441,548

(22) PCT Filed: Sep. 27, 2007

(86) PCT No.: PCT/JP2007/068816

§ 371 (c)(1), (2), (4) Date: Mar. 17, 2009

(87) PCT Pub. No.: WO2008/047550

PCT Pub. Date: Apr. 24, 2008

(65) Prior Publication Data

US 2010/0009876 A1 Jan. 14, 2010

(30) Foreign Application Priority Data

Oct. 17, 2006 (JP) ..... 2006-282783
Jun. 29, 2007 (JP) ..... 2007-172574

(51) Int. Cl.
*C10M 169/04* (2006.01)
*C10M 129/76* (2006.01)
*C07C 69/34* (2006.01)

(52) U.S. Cl. ..... 508/280; 508/465; 508/501

(58) Field of Classification Search ..... 508/280, 508/465

See application file for complete search history.

(56) References Cited

U.S. PATENT DOCUMENTS

| | | | | |
|---|---|---|---|---|
| 4,048,080 | A | 9/1977 | Lee et al. | |
| 4,295,983 | A | 10/1981 | Papay et al. | |
| 4,855,074 | A | 8/1989 | Papay et al. | |
| 5,076,946 | A * | 12/1991 | Frankenfeld et al. | 508/281 |
| 5,851,962 | A | 12/1998 | Kaga | |
| 2001/0044389 | A1* | 11/2001 | Komiya et al. | 508/284 |
| 2005/0056241 | A1* | 3/2005 | Nomura et al. | 123/90.6 |

FOREIGN PATENT DOCUMENTS

| | | |
|---|---|---|
| JP | 52 051407 | 4/1977 |
| JP | 52 150495 | 12/1977 |
| JP | 57 076096 | 5/1982 |
| JP | 1 282296 | 11/1989 |
| JP | 05 239483 | 9/1993 |
| JP | 6 172780 | 6/1994 |
| JP | 2000 273481 | 10/2000 |
| JP | 2001 139978 | 5/2001 |
| JP | 2003 238982 | 8/2003 |
| JP | 2004 155891 | 6/2004 |
| JP | 2005 2888 | 1/2005 |

OTHER PUBLICATIONS

European Search Report mailed Nov. 24, 2010, in EP07828562 filed on Sep. 27, 2007.

Office Action mailed Aug. 19, 2011, in Europe Patent Application No. 07 828 562.4 filed on Sep. 27, 2007.

* cited by examiner

*Primary Examiner* — Glenn Caldarola
*Assistant Examiner* — Vishal Vasisth
(74) *Attorney, Agent, or Firm* — Oblon, Spivak, McClelland, Maier & Neustadt, L.L.P.

(57) ABSTRACT

Provided is a lubricating oil composition comprising a base oil for a lubricating oil, (A) a fatty acid partial ester compound, 0.5 to 1.5% by mass of (B) (b1) an aliphatic amine compound and/or (b2) an acid amide compound, 0.01 to 0.1% by mass of (C) a specific benzotriazole derivative and a specific amount of (D) a specific succinimide compound. It is a lubricating oil composition of an environmental regulation compliant type which is used for internal combustion engines such as gasoline engines, diesel engines, engines using dimethyl ether for fuel, gas engines and the like, which does not contain Mo base friction reducing agents and is reduced in ash, phosphorus and sulfur and in which a friction reducing effect, an oxidation stability and a corrosion inhibiting effect are enhanced.

18 Claims, No Drawings

LUBRICATING OIL COMPOSITION

This application is a 371 of PCT/JP07/68816, filed Sep. 27, 2007.

BACKGROUND OF THE INVENTION

The present invention relates to a lubricating oil composition for internal combustion engines, more specifically to a lubricating oil composition for internal combustion engines which is improved in a friction reducing effect, an oxidation stability and a corrosion inhibiting property by using (A) a fatty acid partial ester compound, (B) (b1) an aliphatic amine compound and/or (b2) an acid amide compound, (C) a specific benzotriazole derivative and (D) a specific succinimide compound in combination.

RELATED ART

At present, the environment is regulated more and more severely on a global scale, and particularly in situations surrounding automobiles, regulations to fuel consumption, exhaust gases and the like are becoming severer and severer. The above situations are backgrounded by environmental problems such as global warming and the like and resource protection originating in concerns about depletion of oil resources. It is estimated that saving of fuel consumption in automobiles shall be advanced more and more because of the reasons described above.

In saving of fuel consumption in automobiles, important is an improvement in engine oils such as a reduction in a viscosity of engine oils, addition of good friction controlling agents and the like for preventing a frictional loss in engines in addition to an improvement in automobiles themselves such as a reduction in a weight of cars, an improvement in engines and the like. However, a reduction in a viscosity of engine oils is a cause to bring about an increase in friction in the respective parts of an engine, and therefore a friction controlling agent, an extreme pressure agent and the like have to be added for the purposes of reducing a frictional loss caused by the above reduction in a viscosity and preventing wear, and MoDTC and the like which are sulfur-containing compounds and phosphorus-containing compounds are used therefor. It is known, however, that sulfur-containing compounds and phosphorus-containing compounds deteriorate catalysts clarifying exhaust gases, and it is desirable to reduce sulfur-containing compounds and phosphorus-containing compounds contained in engine oils as much as possible.

Further, in diesel engines, countermeasures for reducing environmental pollution caused by exhaust gas components such as particulate matters (granular matters), NOx and the like are important tasks. It is predominant as the countermeasures therefor to install an exhaust gas clarifying device such as a particulate filter, an exhaust gas clarifying catalyst (oxidation or reduction catalyst) and the like in automobiles. When conventional lubricating oils for internal combustion engines are used for automobiles in which the above exhaust gas clarifying device is installed, soot stuck on a particulate filter is removed by oxidation and combustion, but brought about is the problem that the filter is clogged by metal oxides, phosphates, sulfates, carboxylates and the like which are produced by the combustion. A part of an engine oil used is combusted and exhausted in the form of an exhaust gas. Accordingly, a metal content and a sulfur content in a lubricating oil are preferably reduced as much as possible, and friction controlling agents in place of sulfur- and molybdenum-containing compounds such as MoDTC and the like are desired to be developed.

Friction controlling agents other than organic molybdenum compounds such as MoDTC described above include, for example, organic friction reducing agents described in patent documents 1 to 4. Lubricating oils having an excellent friction reducing effect obtained by enhancing a solubility in base oils of organic friction reducing agents are described in the patent document 1. Also, lubricating oil compositions containing specific fatty acid partial ester compounds and specific aliphatic amine compounds are described in the patent documents 2 to 4. The above technical developments have come to make it possible to reduce friction without using molybdenum base (hereinafter referred to as Mo base) friction reducing agents. In general, however, the above organic friction reducing agents lead to corrosion of metals and oxidative deterioration of lubricating oils, and therefore it is important as well to investigate a composition of lubricating oils based on the above viewpoint.

On the other hand, an improvement in engines aiming at saving of fuel consumption described above includes change from a direct strike type to a roller type for the purpose of reducing friction in a valve operating mechanism. Performances required to engine oils are changed in accordance with the above change, and in recent years, a friction reducing effect in sliding parts other than a valve operating mechanism has come to be strongly requested to engine oils. The parts described above include bearing metals which are sliding parts in main bearings, con'rod bearings and the like, and the materials thereof are spread over various ones such as aluminum, copper, tin, lead and the like without being limited to iron. These copper- and lead-containing compounds have the excellent characteristic that they have less fatigue phenomenon, but on the other hand, a problem of corrosion caused by engine oils has been involved therein.

Patent document 1: Japanese Patent Application Laid-Open No. 273481/0000

Patent document 2: Japanese Patent Application Laid-Open No. 238982/2003

Patent document 3: Japanese Patent Application Laid-Open No. 155891/2004

Patent document 4: Japanese Patent Application Laid-Open No. 002888/2005

DISCLOSURE OF THE INVENTION

In light of the above situation, an object of the present invention is to provide a lubricating oil composition of an environmental regulation compliant type which is used for internal combustion engines such as gasoline engines, diesel engines, engines using dimethyl ether for fuel, gas engines and the like, which does not contain Mo base friction reducing agents and is reduced in ash, phosphorus and sulfur and in which a friction reducing effect, an oxidation stability and a corrosion inhibiting effect are enhanced.

Intensive researches repeated by the present inventors in order to achieve the object described above have resulted in finding that the object can be achieved by using (A) a fatty acid partial ester compound, (B) (b1) the compound described above and/or (b2) the compound described above, (C) a specific benzotriazole derivative and (D) a specific succinimide compound in combination. The present invention has been completed based on the above knowledge.

That is, the present invention provides a lubricating oil composition comprising a base oil for a lubricating oil, (A) a fatty acid partial ester compound, (B) (b1) the compound described above and/or (b2) the compound described above, (C) a benzotriazole derivative represented by Formula (I):

[Ka 1]

(I)

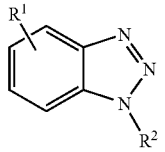

(in Formula (I), $R^1$ and $R^2$ each are independently a hydrocarbyl group having 1 to 30 carbon atoms which may contain an oxygen atom, a sulfur atom or a nitrogen atom) and (D) a succinimide compound which is represented by Formula (II) or Formula (III):

[Ka 2]

(II)

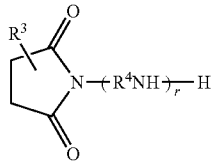

(III)

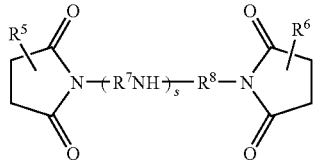

(wherein $R^3$, $R^5$ and $R^6$ are an alkenyl group or an alkyl group each having a number average molecular weight of 500 to 3,000, and $R^5$ and $R^6$ may be the same or different; $R^4$, $R^7$ and $R^8$ each are an alkylene group having 2 to 5 carbon atoms, and $R^7$ and $R^8$ may be the same or different; r represents an integer of 1 to 10; and s represents 0 or an integer of 1 to 10) and in which (d1) a polybutenylsuccinbisimide compound containing a polybutenyl group having a number average molecular weight of or more accounts for 70% by mass or more based on the whole amount of (D), the lubricating oil composition comprising 0.5 to 1.5% by mass of the component (A) and the component (B), 0.01 to 0.1% by mass of the component (C) and 0.5 to 15% by mass of the component (D).

According to the present invention, a lubricating oil composition of an environmental regulation compliant type which does not contain Mo base friction reducing agents and is reduced in ash, phosphorus and sulfur and in which a friction reducing effect, an oxidation stability and a corrosion inhibiting effect are enhanced, to be specific, a lubricating oil composition which is used for internal combustion engines such as gasoline engines, diesel engines, engines using dimethyl ether for fuel, gas engines and the like can be provided by using (A) the fatty acid partial ester compound, (B) (b1) the compound described above and/or (b2) the compound described above, (C) the specific benzotriazole derivative and (D) the specific succinimide compound in combination.

BEST MODE FOR CARRYING OUT THE INVENTION

The lubricating oil composition of the present invention is obtained by blending a base oil with (A) the fatty acid partial ester compound, (B) (b1) the compound described above and/or (b2) the compound described above, (C) the specific benzotriazole derivative and (D) the specific succinimide, and it is characterized by using the above components (A) to (D) in combination.

The base oil in the lubricating oil composition of the present invention shall not specifically be restricted, and optional oils suitably selected from mineral oils and synthetic oils which have so far been used as base oils of lubricating oils for internal combustion engines can be used.

The mineral oils include, for example, mineral oils prepared by distilling atmospheric residual oil obtained by distilling crude oil at an atmospheric pressure to obtain a lubricating oil fraction and refining the above fraction by subjecting to at least one of treatments such as debitumen by a solvent, extraction by a solvent, hydrocracking, dewaxing by a solvent, catalytic dewaxing, hydrorefining and the like and mineral oils produced by isomerizing waxes and GTL WAX.

On the other hand, the synthetic oils include, for example, polybutene, polyolefins (α-olefin homopolymers and copolymers (for example, ethylene-α-olefin copolymers) and the like), various esters (for example, polyol esters, dibasic acid esters, phosphoric esters and the like), various ethers (for example, polyphenyl ether and the like), polyglycols, alkylbenzene, alkylnaphthalene and the like. Among the above synthetic oils, polyolefins and polyol esters are particularly preferred.

In the present invention, the mineral oils described above may be used alone or in combination of two or more kinds thereof as the base oil. Also, the synthetic oils described above may be used alone or in combination of two or more kinds thereof as the base oil. Further, at least one mineral oil and at least one synthetic oil may be used in combination.

A viscosity of the base oil shall not specifically be restricted and is varied according to the uses of the lubricating oil composition, and a kinematic viscosity thereof at 100° C. is usually 2 to 30 $mm^2/s$, preferably 3 to 15 $mm^2/s$ and particularly preferably 4 to 10 $mm^2/s$. If the kinematic viscosity at 100° C. is 2 $mm^2/s$ or more, the vaporization loss is small, and if it is 30 $mm^2/s$ or less, the power loss brought about by the viscosity resistance is inhibited, so that the fuel consumption improving effect is obtained.

Oils in which % $C_A$ measured by ring analysis is 3 or less and in which a content of sulfur is 50 ppm by mass or less are preferably used as the base oil. In this case, the % $C_A$ measured by ring analysis shows a proportion (percentage) of aromatics calculated by a ring analysis n-d-M method. The sulfur content is a value measured according to JIS K 2541.

The base oil in which % $C_A$ is 3 or less and in which a content of sulfur is 50 ppm by mass or less has a good oxidation stability and can inhibit a rise in the acid value and production of sludges, and it can provide a lubricating oil composition having less corrosion property to metals.

The % $C_A$ is more preferably 1 or less, further preferably 0.5 or less, and the sulfur content is more preferably 30 ppm by mass or less.

Further, a viscosity index of the base oil is preferably 70 or more, more preferably 100 or more and further preferably 120 or more. The base oil having a viscosity index of 70 or more has less change of a viscosity caused by a change of temperature.

The fatty acid partial ester compound (A) of the present invention is a partial ester obtained by reacting aliphatic polyhydric alcohol with fatty acid having a linear or branched hydrocarbon group having preferably 6 to 30 carbon atoms, more preferably 8 to 24 carbon atoms and particularly preferably 10 to 20 carbon atoms.

The linear or branched hydrocarbon group having 6 to 30 carbon atoms described above includes alkyl groups such as hexyl, heptyl, octyl, nonyl, decyl, undecyl, dodecyl, tridecyl, tetradecyl, pentadecyl, hexadecyl, heptadecyl, octadecyl, nonadecyl, icosyl, pentaicosyl, docosyl, tricosyl, tetracosyl, pentacosyl, hexacosyl, heptacosyl, octacosyl, nonacosyl, triacontyl and the like, alkenyl groups such as hexenyl, heptenyl, octenyl, nonenyl, decenyl, undecenyl, dodecenyl, tridecenyl, tetradecenyl, pentadecenyl, hexadecenyl, heptadecenyl, octadecenyl, nonadecenyl, icosenyl, henicosenyl, docosenyl, tricosenyl, tetracosenyl, pentacosenyl, hexacosenyl, heptacosenyl, octacosenyl, nonacosenyl, triacontenyl and the like, hydrocarbon groups having two or more double bonds and the like. All linear structures and branched structures which are thinkable are included in the alkyl groups, the alkenyl groups and the hydrocarbon groups having two or more double bonds. The positions of the double bonds in the alkenyl groups and the hydrocarbon groups having two or more double bonds are optional.

The fatty acid having a hydrocarbon group described above includes saturated fatty acids such as caproic acid, caprylic acid, capric acid, lauric acid, myristic acid, palmitic acid, stearic acid, arachidic acid, behenic acid, lignoceric acid and the like and unsaturated fatty acids such as myristoleic acid, palmitoleic acid, oleic acid, linolenic acid and the like, and the unsaturated fatty acids are preferred.

The aliphatic polyhydric alcohol described above is dihydric to hexahydric alcohols and includes ethylene glycol, glycerin, trimethylolpropane, pentaerythritol, sorbitol and the like, and glycerin is preferred.

The fatty acid partial ester compound (A) obtained by reacting glycerin with the unsaturated fatty acid described above includes monoesters such as glycerin monomyristate, glycerin monopalmitate, glycerin monooleate and the like and diesters such as glycerin dimyristate, glycerin dipalmitate, glycerin dioleate and the like, and the monoesters are preferred. The partial ester compound includes as well reaction products with silicon compounds or boron compounds, and the reaction products with the boron compounds are preferred.

In the present invention, the fatty acid partial ester compound (A) may be used alone or in combination of two or more kinds thereof. A blending amount thereof is preferably 0.05% by mass or more, more preferably 0.1% by mass or more and particularly preferably 0.3% by mass or more in terms of the friction reducing effect. An upper limit thereof shall not specifically be restricted, and the total amount of the component (A) and the component (B) is 1.5% by mass or less from the viewpoints of the economical efficiency, the metal corrosion property and an oxidative deterioration of the lubricating oil.

The component (B) of the present invention comprises (b1) an aliphatic amine compound and/or (b2) an acid amide compound. The compound (b1) described above is an amine compound having a linear or branched hydrocarbon group having preferably 6 to 30 carbon atoms, more preferably 8 to 24 carbon atoms and particularly preferably 10 to 20 carbon atoms. The groups shown as the examples of the hydrocarbon groups in the fatty acids described above correspond to the linear or branched hydrocarbon group having 6 to 30 carbon atoms described above.

Aliphatic monoamines or alkylene oxide adducts thereof, alkanolamines, aliphatic polyamines, imidazoline compounds and the like can be shown as the examples of the compound (b1) described above. To be specific, it includes aliphatic amine compounds such as laurylamine, lauryldiethylamine, lauryldiethanolamine, dodecyldipropanolamine, palmitylamine, stearylamine, stearyltetraethylenepentamine, oleylamine, oleylpropylenediamine, oleyldiethanolamine, N-hydroxyethyloleylimidazoline and the like and amine alkylene oxide adducts of the above aliphatic amine compounds, such as N-dipolyoxyalkylene-N-alkyl (or alkenyl) (6 to 28 carbon atoms).

The amine compound used for synthesis of the compound (b2) includes the compounds (b1) described above, and among them, the alkanolamines are preferred. The alkanolamines include monoethanolamine, diethanolamine, triethanolamine, N-methylethanolamine, N,N-dimethylethanolamine, N-ethylethanolamine, N,N-diethylethanolamine, N-isoprpylethanolamine, N,N-diisopropylethanolamine, monoisopropanolamine, diisopropanolamine, triisopropanolamine, N-methylisopropanolamine, N,N-dimethylisopropanolamine, N-ethylisopropanolamine, N,N-diethylisopropanolamine, N-isoprpylisopropanolamine, N,N-diisopropylisopropanolamine, mono-n-propanolamine, di-n-propanolamine, tri-n-propanolamine, N-methyl-n-propanolamine, N,N-dimethyl-n-propanolamine, N-ethyl-n-propanolamine, N,N-diethyl-n-propanolamine, N-isopropyl-n-propanolamine, N,N-diisopropyl-n-propanolamine, monobutanolamine, dibutanolamine, tributanolamine, N-methylbutanolamine, N,N-dimethylbutanolamine, N-ethylbutanolamine, N,N-diethylbutanolamine, N-isopropylbutanolamine, N,N-diisopropylbutanolamine and the like.

The carboxylic acid used for synthesis of the compound (b2) includes monovalent fatty acids having a linear or branched hydrocarbon group having preferably 6 to 30 carbon atoms and polycarboxylic acids having preferably 2 to 30 carbon atoms such as oxalic acid, phthalic acid, trimellitic acid, pyromellitic acid and the like.

Among the carboxylic acids described above, the monovalent fatty acids having a linear or branched hydrocarbon group are preferred, and the hydrocarbon group has preferably 6 to 30 carbon atoms, more preferably 8 to 24 carbon atoms and particularly preferably 10 to 20 carbon atoms. The specific examples thereof include saturated fatty acids such as caproic acid, caprylic acid, capric acid, lauric acid, myristic acid, palmitic acid, stearic acid, arachidic acid, behenic acid, lignoceric acid and the like and unsaturated fatty acids such as myristoleic acid, palmitoleic acid, oleic acid, linolenic acid and the like, and the unsaturated fatty acids are preferred in terms of a friction reducing effect thereof.

The compound (b2) described above includes oleic acid monoethanolamide, oleic acid diethanolamide, oleic acid monopropanolamide, oleic acid dipropanolamide and the like.

In the present invention, the compound (b1) and the compound (b2) described above may be used alone or in combination as the component (B). Further, plural compounds (b1) and plural compounds (b2) may be used. A blending amount of the component (B) is preferably 0.05% by mass or more, more preferably 0.1% by mass or more and particularly preferably 0.3% by mass or more in terms of the friction reducing effect. An upper limit thereof shall not specifically be restricted, and the total amount of the fatty acid partial ester compound (A) and the component (B) is 1.5% by mass or less from the viewpoints of the economical efficiency, the metal corrosion property and an oxidative deterioration of the lubricating oil.

In the present invention, the component (A) and the component (B) described above are used in combination. More excellent friction reducing effect than in using them alone is obtained by using both components in combination. A total amount thereof is 0.5 to 1.5% by mass, preferably 0.6 to 1.2% by mass in terms of the friction reducing effect. If it is less than 0.5% by mass, the satisfactory friction reducing effect is not obtained, and if it exceeds 1.5% by mass, the friction reducing effect meeting the amount is not obtained.

A friction reducing effect with which the component (A) and the component (B) are endowed is synergistically enhanced by using both components in combination. On the other hand, however, the metal corrosion property to metal and an oxidative deterioration of the lubricating oil tend to be enhanced as well more than in using them alone by using both components in combination. From the above point of view, a total amount of the component (A) and the component (B) is 1.5% by mass or less. If it is 1.5% by mass or less, the metal corrosion property and the oxidative deterioration described above are avoided.

In the present invention, the metal corrosion property and the oxidative deterioration can further be inhibited by blending a metal inactivation agent in addition to limitation of a total amount of the component (A) and the component (B) described above, and the lubricating oil composition in which a friction reducing effect, an oxidation stability and a corrosion inhibiting effect are enhanced in a balanced manner can be obtained. The metal inactivation agent includes, for example, benzotriazole base, tolyltriazole base, thiadiazole base, imidazole base and pyrimidine base compounds and the like. Among them, the benzotriazole base compounds are preferred.

The benzotriazole base compound includes (C) a benzotriazole derivative represented by Formula (I):

[Ka 3]

(I)

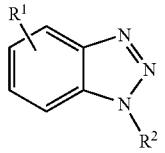

in Formula (I), $R^1$ and $R^2$ each are independently a hydrocarbyl group having 1 to 30 carbon atoms, preferably 1 to 20 carbon atoms, more preferably 2 to 18 carbon atoms, and especially preferably 3 to 18 carbon atoms. The above hydrocarbyl group may be any of linear, branched and cyclic groups and may contain an oxygen atom, a sulfur atom or a nitrogen atom. $R^1$ and $R^2$ may be the same as or different from each other.

The benzotriazole derivative (C) described above is added in an amount of preferably 0.01 to 0.1% by mass, more preferably 0.03 to 0.05% by mass in terms of an effect thereof. The benzotriazole derivative (C) may be used alone or in combination of two or more kinds thereof. Further, it may be used in combination with other metal inactivation agents.

In the present invention, (D) a succinimide compound represented by Formula (II) or Formula (III) is used as a dispersant:

[Ka 4]

(II)

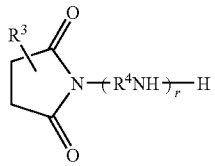

(III)

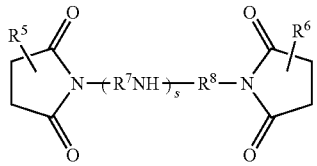

in Formula (II) and Formula (III), $R^3$, $R^5$ and $R^6$ each are an alkenyl group or an alkyl group having a number average molecular weight of 500 to 3,000, and $R^5$ and $R^6$ may be the same or different; a number average molecular weight of $R^3$, $R^5$ and $R^6$ is preferably 1,000 to 3,000; $R^4$, $R^7$ and $R^8$ each are an alkylene group having 2 to 5 carbon atoms, and $R^7$ and $R^8$ may be the same or different; r represents an integer of 1 to 10; and s represents 0 or an integer of 1 to 10.

If a number average molecular weight of $R^3$, $R^5$ and $R^6$ is less than 500, the solubility in the base oil is reduced. If it exceeds 3,000, the cleanliness is reduced, and no targeted performances are likely to be obtained. Further, r described above is preferably 2 to 5, more preferably 3 to 4. If r is less than 1, the cleanliness is reduced, and if r exceeds 10, the solubility in the base oil is deteriorated.

In Formula (III), s is preferably 1 to 4, more preferably 2 to 3. If s is 0, the cleanliness is deteriorated, and if s exceeds 10, the solubility in the base oil is deteriorated. A polybutenyl group, a polyisobutenyl group and an ethylene-propylene copolymer can be listed as the alkenyl group, and the alkyl group is obtained by hydrogenating the above groups.

The representative example of the suited alkenyl group includes a polybutenyl group or a polyisobutenyl group. The polybutenyl group is obtained by polymerizing 1-butene with a mixture of isobutenes or isobutene of a high purity. The representative example of the suited alkyl group includes a group obtained by hydrogenating the polybutenyl group or the polyisobutenyl group.

The alkenyl- or alkylsuccinimide compound described above can be produced usually by reacting polyamine with alkenylsuccinic anhydride obtained by reacting polyolefin with maleic anhydride or alkylsuccinic anhydride obtained by hydrogenating it.

The succinimide compound of a mono type and the succinimide compound of a bis type described above can be produced by changing a reaction proportion of alkenylsuccinic anhydride or alkylsuccinic anhydride to polyamine.

α-olefin having 2 to 8 carbon atoms can be used alone or in a mixture of two or more kinds thereof as an olefin monomer forming the polyolefin described above, and a mixture of isobutene and 1-butene can suitably be used.

On the other hand, the polyamine includes single diamines such as ethylenediamine, propylenediamine, butylenediamine, pentylenediamine and the like, polyalkylenepolyamines such as diethylenetriamine, triethylenetetraamine, tetraethylenepentaamine, pentaethylenehexaamine, di(methylethylene)triamine, dibutylenetriamine, tributylenetetraamine, pentapentylenehexaamine and the like and piperazine derivatives such as aminoethylpiperazine and the like.

In addition to the alkenyl- or alkylsuccinimide compound described above, a boron derivative thereof and/or compounds obtained by modifying them with organic acids may be used as well. The boron derivative of the alkenyl- or alkylsuccinimide compound, which is produced by a conventional method, can be used.

For example, the polyolefin described above is reacted with maleic anhydride to obtain alkenylsuccinic anhydride, and it is further reacted with an intermediate obtained by reacting the polyamine described above with a boron compound such as boron oxide, halogenated boron, boric acid, boric anhydride, boric esters, ammonium borate and the like and subjected to imidation, whereby the boron derivative is obtained.

A boron content in the boron derivative shall not specifically be restricted, and it is usually 0.05 to 5% by mass, preferably 0.1 to 3% by mass in terms of boron.

A content of the succinimide compound (D) described above is 0.5 to 15% by mass, preferably 1 to 10% by mass based on the lubricating oil composition. If it is less than 0.5% by mass, the effect thereof is less liable to be exhibited, and if it is more than 15% by mass, the effect meeting the addition thereof is not obtained. Further, the succinimide compound has a corrosion property to lead, and therefore it is not preferred to add an amount more than necessity. The upper limit described above is set from this point of view. The succinimide compound may be used alone or in combination of two or more kinds thereof as long as (d1) a polybutenylsuccinbisimide compound containing a polybutenyl group having a number average molecular weight of 1,500 or more described below is contained in a prescribed amount.

As described above, the succinimide compound has usually a very high corrosion property to lead, and therefore the imide compound has to be suitably selected in order to achieve an oxidation stability of the lubricating oil and prevention of metal corrosion as well as a reduction in friction at the same time. Accordingly, the polybutenylsuccinbisimide compound (d1) containing a polybutenyl group having a number average molecular weight of 1,500 or more is an essential component in the present invention, and a content thereof is preferably 70% or more, more preferably 80% or more based on a whole amount of the succinimide compound (D). Further, a nitrogen content of the component (d1) is preferably 60% or more, more preferably 70% or more based on a whole nitrogen amount of the succinimide compound (D). The corrosion property to lead can be inhibited by satisfying the conditions described above.

Other additives, for example, a viscosity index improving agent, a pour point depressant, a metal base detergent, an antioxidant, a wear resistant agent or an extreme pressure agent, a friction reducing agent other than the component (A) and the component (B) described above, a rust preventive, a surfactant or an emulsification resistant agent, a defoaming agent and the like can be blended, if necessary, with the lubricating oil composition of the present invention as long as the object of the present invention is not damaged.

The viscosity index improving agent includes, for example, polymethacrylates, dispersion type polymethacrylates, olefin base copolymers (for example, ethylene-propylene copolymers and the like), dispersion type olefin base copolymers, styrene base copolymers (for example, styrene-diene copolymers, styrene-isoprene copolymers and the like) and the like.

A blending amount of the viscosity index improving agents is usually 0.5 to 15% by mass, preferably 1 to 10% by mass based on a whole amount of the lubricating oil composition in terms of a blending effect.

The pour point depressant includes, for example, polymethacrylates having a weight average molecular weight of 5,000 to 50,000 and the like.

Optional alkaline earth metal base detergents used for lubricating oils can be used as the metal base detergent, and they include, for example, alkaline earth metal sulfonates, alkaline earth metal phenates, alkaline earth metal salycilates and mixtures of two or more compounds selected from the above compounds. The alkaline earth metal sulfonates include alkaline earth metal salts of alkylated aromatic sulfonic acids obtained by sulfonating alkylated aromatic compounds having a molecular weight of 300 to 1,500, preferably 400 to 700, particularly magnesium salts and/or calcium salts thereof, and among them, the calcium salts are preferably used. The alkaline earth metal phenates include alkaline earth metal salts of alkylphenols, alkylphenol sulfides and Mannich reaction products of alkylphenols, particularly magnesium salts and/or calcium salts thereof, and among them, the calcium salts are preferably used. The alkaline earth metal salycilates include alkaline earth metal salts of alkylsalycilic acids, particularly magnesium salts and/or calcium salts thereof, and among them, the calcium salts are preferably used. The alkyl group constituting the alkaline earth metal base detergents described above is preferably an alkyl group having 4 to 30 carbon atoms, more preferably a linear or branched alkyl group having 6 to 18 carbon atoms, and it may be either linear or branched. It may be a primary alkyl group, a secondary alkyl group or a tertiary alkyl group. The alkaline earth metal sulfonates, the alkaline earth metal phenates and the alkaline earth metal salycilates include neutral alkaline earth metal sulfonates, neutral alkaline earth metal phenates and neutral alkaline earth metal salycilates which are obtained by reacting the alkylated aromatic sulfonic acids, the alkylphenols, the alkylphenol sulfides, the Mannich reaction products of alkylphenols and the alkylsalycilic acids each described above directly with alkaline earth metal bases such as oxides and hydroxides of alkaline earth metals of magnesium and/or calcium, or once preparing alkaline metal salts such as sodium salts, potassium salts and the like and then substituting them with alkaline earth metal salts, and in addition thereto, they include as well basic alkaline earth metal sulfonates, basic alkaline earth metal phenates and basic alkaline earth metal salycilates which are obtained by heating neutral alkaline earth metal sulfonates, neutral alkaline earth metal phenates and neutral alkaline earth metal salycilates with excessive alkaline earth metal salts and alkaline earth metal bases under the presence of water and perbasic alkaline earth metal sulfonates, perbasic alkaline earth metal phenates and perbasic alkaline earth metal salycilates which are obtained by reacting neutral alkaline earth metal sulfonates, neutral alkaline earth metal phenates and neutral alkaline earth metal salycilates with carbonates or borates of alkaline earth metals under the presence of carbon dioxide.

In the present invention, the neutral salts, the basic salts, the perbasic salts each described above and mixtures thereof can be used as the metal base detergent, and particularly the mixtures of at least one of perbasic salycilates, perbasic phenates and perbasic sulfonates with neutral sulfonates are preferred in terms of a cleanliness and an wear resistance.

In the present invention, a content of the metal base detergent is usually 1% by mass or less, preferably 0.5% by mass or less in terms of an amount of a metal element, and it is more preferably 0.3% by mass or less in order to reduce a sulfated ash content of the composition. A content of the metal base detergent is 0.005% by mass or more, preferably 0.01% by mass or more in terms of an amount of a metal element, and it is more preferably 0.05% by mass or more in order to enhance more the oxidation stability, the basic value maintaining property and the high temperature cleanliness. In particular, controlling the content to 0.1% by mass or more makes it possible to obtain the composition in which a basic value and a high temperature cleanliness can be maintained over a long period of time, and therefore it is particularly preferred. The sulfated ash content referred above shows a value measured according to a method prescribed in 5. "Sulfated ash content test method" of JIS K 2272, and it originates principally in metal-containing additives.

The antioxidant includes phenol base antioxidants, amine base antioxidants, molybdenum amine complex base antioxidants, sulfur base antioxidants and the like. The phenol base antioxidants include, for example, 4,4'-methylenebis(2,6-di-t-butylphenol); 4,4'-bis(2,6-di-t-butylphenol); 4,4'-bis(2-methyl-6-t-butylphenol); 2,2'-methylenebis(4-ethyl-6-t-butylphenol); 2,2'-methylenebis(4-methyl-6-t-butylphenol); 4,4'-butylidenebis(3-methyl-6-t-butylphenol); 4,4'-isopropylidenebis(2,6-di-t-butylphenol); 2,2'-methylenebis(4-methyl-6-nonylphenol); 2,2'-isobutylidenebis(4,6-dimethylphenol); 2,2'-methylenebis(4-methyl-6-cyclohexylphenol); 2,6-di-t-butyl-4-methylphenol; 2,6-di-t-butyl-4-ethylphenol; 2,4-dimethyl-t-butylphenol; 2,6-di-t-amyl-p-cresol; 2,6-di-t-butyl-4-(N,N'-dimethylaminomethylphenol; 4,4'-thiobis(2-methyl-6-t-butylphenol); 4,4'-thiobis(3-methyl-6-t-butylphenol); 2,2'-thiobis(4-methyl-6-t-butylphenol); bis(3-methyl-4-hydroxy-5-t-butylbenzyl)sulfide; bis(3,5-di-t-butyl-4-hydroxybenzyl) sulfide; n-octyl-3-(4-hydroxy-3,5-di-t-butylphenyl) propionate; n-octadecyl-3-(4-hydroxy-3,5-di-t-butylphenyl) propionate; 2,2'-thio[diethyl-bis-3-(3,5-di-t-butyl-4-hydroxyphenyl)propionate] and the like. Among them, bisphenol base and ester group-containing phenol base antioxidants are preferred.

The amine base antioxidants include, for example, monoalkyldiphenylamines such as monooctyldiphenylamine, monononyldiphenylamine and the like; dialkyldiphenylamines such as 4,4'-dibutyldiphenylamine, 4,4'-dipentyldiphenylamine, 4,4'-dihexldiphenylamine, 4,4'-diheptyldiphenylamine, 4,4'-diocyldiphenylamine, 4,4'-dinonyldiphenylamine and the like; polyalkyldiphenylamines such as tetrabutyldiphenylamine, tetrahexyldiphenylamine, tetraocyldiphenylamine, tetranonyldiphenylamine and the like; naphthyl amine base antioxidants, to be specific, α-naphthylamine, phenyl-α-naphthylamine and alkyl-substituted phenyl-α-naphthylamine such as butylphenyl-α-naphthylamine, pentylphenyl-α-naphthylamine, hexylphenyl-α-naphthylamine, heptylphenyl-α-naphthylamine, octylphenyl-α-naphthylamine, nonylphenyl-α-naphthylamine and the like. Among them, the dialkyldiphenylamine base antioxidants and the naphthylamine base antioxidants are suited.

Compounds obtained by reacting hexavalent molybdenum compounds, to be specific, molybdenum trioxide and/or molybdic acid with amine compounds, for example, compounds obtained by a production process described in Japanese Patent Application Laid-Open No. 252887/2003 can be used as the molybdenum amine complex base antioxidant.

The amine compounds reacted with the hexavalent molybdenum compounds shall not specifically be restricted and include, to be specific, monoamines, diamines, polyamines and alkanolamines. To be more specific, capable of being shown as the examples thereof are alkylamines having an alkyl group having 1 to 30 carbon atoms (the alkyl group may be linear or branched) such as methylamine, ethylamine, dimethylamine, diethylamine, methylethylamine, methylpropylamine and the like; alkenylamines having an alkenyl group having 2 to 30 carbon atoms (the alkenyl group may be linear or branched) such as ethenylamine, propenylamine, butenylamine, octenylamine, oleylamine and the like; alkanolamines having an alkanol group having 1 to 30 carbon atoms (the alkanol group may be linear or branched) such as methanolamine, ethanolamine, methanolethanolamine, methanolpropanolamine and the like; alkylenediamines having an alkylene group having 1 to 30 carbon atoms such as methylenediamine, ethylenediamine, propylenediamine, butylenediamine and the like; polyamines such as diethylenetriamine, triethylenetetramine, tetraethylenepentamine, pentaethylenehexamine and the like; amines prepared by reacting the monoamines, the diamines and the polyamines each described above with compounds having an alkyl group or an alkenyl group having 8 to 20 carbon atoms and heterocyclic compounds such as imidazoline and the like, such as undecyldiethylamine, undecyldiethanolamine, dodecyldipropanolamine, oleyldiethanolamine, oleylpropylenediamine, stearyltetraethylenepentaamine and the like; alkylene oxide adducts of the above compounds; and mixtures thereof and the like. Further, sulfur-containing molybdenum complexes of succinimide described in Japanese Patent Publication No. 22438/1991 and Japanese Patent Publication No. 2866/2004 can be shown as the examples thereof.

The sulfur base antioxidants include, for example, phenothiazine, pentaerythritol tetrakis-(3-laurylthiopropionate), didodecyl sulfide, dioctadecyl sulfide, didodecylthio dipropionate, dioctadecylthio dipropionate, dimyristylthio dipropionate, dodecyloctadecylthio dipropionate, 2-mercaptobenzimidazole, methylenebis(dibutyldithio carbamate) and the like.

The wear resistant agent and the extreme pressure agent include zinc phosphate; sulfur-containing compounds such as zinc thiophosphate, zinc dithiocarbamate, disulfides, sulfurized olefins, sulfurized oils & fats, sulfurized esters, thiocarbonates, dithiocarbamates and the like; phosphorous-containing compounds such as phosphite esters, phosphate esters, phosphonate esters, amine salts or metal salts thereof and the like; sulfur and phosphorus-containing wear resistant agents such as thiophosphate esters, thiophosphite esters, thiophosphonate esters, amine salts or metal salts thereof and the like; alkaline metal borates and hydrates thereof.

Optional compounds usually used as friction reducing agents for lubricating oils can be used as the friction reducing agent other than the component (A) and the component (B), and they include, for example, ashless friction reducing agents such as fatty acids, aliphatic alcohols and aliphatic ethers each having at least one alkyl group or alkenyl group having 6 to 30 carbon atoms in a molecule.

The rust preventive includes petroleum sulfonates, alkylbenzenesulfonates, dinonylnaphthalenesulfonates, alkenylsuccinic esters, polyhydric alcohol esters and the like. A blending amount of the above rust preventives is usually 0.01 to 1% by mass, preferably 0.05 to 0.5% by mass based on the whole amount of the lubricating oil composition from the viewpoint of the blending effect.

The surfactant or the emulsification resistant agent includes polyalkylene glycol base nonionic surfactants such as polyoxyethylene alkyl ethers, polyoxyethylene alkylphenyl ethers, polyoxyethylene alkylnaphthyl ethers and the like.

The defoaming agent includes silicone oils, fluorosilicone oils, fluoroalkyl ethers and the like, and it is added preferably in an amount of 0.005 to 0.1% by mass based on the whole amount of the composition from the viewpoint of balance between a defoaming effect and an economical efficiency.

In the lubricating oil composition of the present invention, a sulfur content is preferably 0.3% by mass or less. If the sulfur content is 0.3% by mass or less, a catalyst for clarifying an exhaust gas can be inhibited from being reduced in a performance, and the more preferred sulfur content is 0.2% by mass or less.

The phosphorus content is preferably 0.12% by mass or less. If the phosphorus content is 0.12% by mass or less, a catalyst for clarifying an exhaust gas can be inhibited from being reduced in a performance, and the more preferred phosphorus content is 0.1% by mass or less.

The sulfated ash content is preferably 1% by mass or less. If the sulfated ash content is 1% by mass or less, a catalyst for clarifying an exhaust gas can be inhibited, as described above, from being reduced in a performance. In diesel engines, a filter of DPF (diesel particulate filter) is decreased in an ash amount deposited thereon and inhibited from being clogged by the ash, and DPF is elongated in a lifetime. The sulfated ash content is an ash content obtained by adding sulfuric acid to a carbonized residue produced by burning a sample and heating it until a constant weight is obtained, and it is used usually in order to know an approximate amount of metal base additives contained in the lubricating oil composition.

The lubricating oil composition of the present invention is a lubricating oil composition of an environmental regulation compliant type for internal combustion engines which is excellent in an oxidation stability and a friction reducing effect and which is reduced in a phosphorus content and a sulfated ash content, and it is used for internal combustion engines such as gasoline engines, diesel engines, engines using dimethyl ether for fuel, gas engines and the like.

Sliding members of the internal combustion engines described above shall not specifically be requested, and the lubricating oil composition of the present invention can be applied to sliding surfaces comprising metal materials such as iron, steel, cast irons, boron cast irons, aluminum, copper, zinc, lead and the like and to sliding surfaces having hard films comprising diamond-like carbon (DLC), titanium nitride (TiN), chromium nitride (CrN) and the like. The above sliding members may comprise either a combination of the same kind or a combination of different kinds, and at least one of them is preferably a hard film surface.

The sliding surfaces of the internal combustion engines described above include piston rings and cylinders, piston skirts and cylinders, piston pins and con'rods, piston pins and bushes, cums and shims, cums and rocker arms, cum journals and cum shafts, needle bearing parts of roller rocker arms, rocker arms and rocker shafts, roller tappets and pins and con'rods of crank shafts, bearing parts of crank shafts, plates and pins constituting timing chains, timing chains and sprockets, shoes and chains for timing chains, valve sheet surfaces and valve face surfaces, stem surfaces of valves and stem guides, stem surfaces and stem seals, stem ends and valve lifters, outer gears and inner gears of oil pumps, outer rotors and inner rotors of oil pumps, rolling parts of turbochargers, bearing parts of turbochargers and the like.

EXAMPLES

Next, the present invention shall be explained in further details with reference to examples, but the present invention shall by no means be restricted by these examples.

Lubricating oil compositions having a composition shown in Table 1 were prepared and subjected to a reciprocating friction test, an oxidative deterioration test and a lead corrosion test. The results thereof are shown in Table 2. The kinds of the respective components used for preparing the lubricating oil compositions are shown below.

(1) Base oil A: hydrorefined base oil, kinematic viscosity at 40° C.: 21 $mm^2/s$, kinematic viscosity at 100° C.: 4.5 $mm^2/s$, viscosity index: 127, % $C_A$: 0.1 or less, sulfur content: less than 20 ppm by mass, NOACK vaporization amount: 13.3% by mass (2) Ester base friction controlling agent A: glycerin monooleate (3) Amide base friction controlling agent B: oleic diethanolamide (4) Amine base friction controlling agent C: KIKU-LUBE FM910 (manufactured by ADEKA Corporation)

(5) Benzotriazole compound: 1-[N,N-bis(2-ethylhexyl)aminomethyl]methylbenzotriazole (6) Polybutenylsuccinmonoimide A: number average molecular weight of polybutenyl group: 1000, nitrogen content: 1.76% by mass, boron content: 2.0% by mass (7) Polybutenylsuccinbisimide B: number average molecular weight of polybutenyl group: 2000, nitrogen content: 0.99% by mass (8) Polybutenylsuccinmonoimide C: number average molecular weight of polybutenyl group: 1000, nitrogen content: 2.1% by mass (9) Viscosity index improving agent: polymethacrylate, weight average molecular weight: 420,000, resin amount: 39% by mass

(10) Pour point depressant: polyalkyl methacrylate, weight average molecular weight: 6,000

(11) Metal base detergent A: perbasic calcium salycilate, base number (perchloric acid method): 225 mg KOH/g, calcium content: 7.8% by mass, sulfur content: 0.3% by mass

(12) Metal base detergent B: perbasic calcium phenate, base number (perchloric acid method): 255 mg KOH/g, calcium content: 9.3% by mass, sulfur content: 3.0% by mass

(13) Metal base detergent C: calcium sulfonate, base number (perchloric acid method): 17 mg KOH/g, calcium content: 2.4% by mass, sulfur content: 2.8% by mass

(14) Phenol base antioxidant: 4,4-methylenebis(2,6-di-tert-butylphenol)

(15) Amine base antioxidant: dialkyldiphenylamine, nitrogen content: 4.62% by mass

(16) Zinc dialkyldithiophosphate: zinc content: 9.0% by mass, phosphorus content: 8.2% by mass, sulfur content: 17.1% by mass, alkyl group: mixture of secondary butyl and secondary hexyl

(17) Other additives: a rust preventive, a corrosion inhibitor, an emulsification resistant agent and a defoaming agent.

Phosphorus content:

Measured according to JPI-5S-38-92.

Sulfur Content:

Measured according to JIS K2541.

Nitrogen Content:

Measured according to JIS K2609.

Bisimide Content:

"Bisimide content" in Table 2 shows a percentage of the polybutenylsuccinbisimide compound (d1) containing a polybutenyl group having a number average molecular weight of 1,500 or more based on a whole amount of the succinimide compound (D), and it was calculated according to the following equation:

bisimide content (% by mass)=addition amount of bisimide $B$×100/(addition amount of monoimide $A$+addition amount of bisimide $B$+addition amount of monoimide $C$)

Bisimide (N) Content:

"Bisimide (N) content" in Table 2 shows a percentage of a nitrogen amount of the polybutenylsuccinbisimide compound (d1) containing a polybutenyl group having a number average molecular weight of 1,500 or more based on a whole nitrogen amount of the succinimide compound (D), and it was calculated according to the following equation:

bisimide ($N$) content (% by mass)=($b$×addition amount of bisimide $B$)×100/($a$×addition amount of monoimide $A$+$b$×addition amount of bisimide $B$+$c$×addition amount of monoimide $C$)

(a, b and c are the nitrogen contents (% by mass) of the respective imide compounds and represent a=1.76, b=0.99 and c=2.1).

Sulfated Ash Content:

Measured according to JIS K2272.

Reciprocating Friction Test:

A frictional characteristic of the compound according to the present invention was evaluated by means of a reciprocating friction & wear test device. Boron cast iron was used for a test plate, and a SUJ-2½ inch ball subjected to any of hard chromium plating treatment, nitride treatment, chromium nitride (PVD) treatment and DLC (containing 20% of hydrogen) treatment was used for a test ball. The test was carried out at a test temperature of 100° C., a load of 200 g, an amplitude of 10 mm and a sliding speed of 1.0 mm/second, and a friction coefficient obtained was set to an index for a fuel consumption saving property.

The friction coefficient reducing rate was determined from the following equation on the basis of a friction coefficient in a no friction controlling agent-added sample Comparative Example 1 friction coefficient reducing rate (%)=(friction coefficient of Comparative Example 1)−(friction coefficient in the example or the comparative example)/(friction coefficient of Comparative Example 1)×100

Oxidative Deterioration Test:

A glass-made test tube was charged with 120 g of the sample, copper (25 mm×10 mm×0.5 mm) and iron (25 mm×30 mm×0.5 mm), and air (500 ml/minute) was blown thereinto at 165.5° C. to cause oxidative deterioration. After 216 hours, the kinematic viscosity at 40° C. was measured to determine the viscosity increase rate. Further, an amount of copper in the test oil was measured. Less increase in the viscosity shows that the sample is more excellent in an oxidation stability. Also, less elution amount of copper shows that the sample exerts less influence on copper and that it has more excellent characteristic to metal materials.

Lead Corrosion Test:

Lead (10 mm×10 mm×1.0 mm) was dipped in a glass-made test tube charged with 40 g of the sample to carry out a lead corrosion test at 140° C. An amount of lead was measured after hours to observe an effect of corrosion to lead. Less elution amount of lead shows that the sample exerts less influence on lead and that it has more excellent characteristic to metal materials.

In the oxidative deterioration test and the lead corrosion test, the contents of copper and lead were measured according to JPI-5S-38-92.

TABLE 1

| Blend composition | Example | | | | | Comparative Example | | | | | | | |
|---|---|---|---|---|---|---|---|---|---|---|---|---|---|
| (% by mass) | 1 | 2 | 3 | 4 | 5 | 1 | 2 | 3 | 4 | 5 | 6 | 7 | 8 |
| Base oil A | 81.01 | 80.41 | 82.04 | 82.34 | 82.34 | 81.61 | 81.31 | 81.01 | 81.31 | 81.01 | 79.81 | 80.46 | 80.46 |
| Ester base friction controlling agent A | 0.30 | 0.60 | 0.30 | 0.30 | 0.30 | 0.00 | 0.30 | 0.60 | 0.00 | 0.00 | 0.90 | 0.60 | 0.30 |
| Amide base friction controlling agent B | 0.30 | 0.60 | 0.30 | 0.30 | 0.00 | 0.00 | 0.00 | 0.00 | 0.30 | 0.60 | 0.90 | 0.60 | 0.30 |
| Amine base friction controlling agent C | 0.00 | 0.00 | 0.00 | 0.00 | 0.30 | 0.00 | 0.00 | 0.00 | 0.00 | 0.00 | 0.00 | 0.00 | 0.00 |
| Benzotriazole compound | 0.05 | 0.05 | 0.05 | 0.05 | 0.05 | 0.05 | 0.05 | 0.05 | 0.05 | 0.05 | 0.05 | 0.00 | 0.05 |
| Polybutenylsuccinmonoimide A | 1.00 | 1.00 | 1.00 | 1.00 | 1.00 | 1.00 | 1.00 | 1.00 | 1.00 | 1.00 | 1.00 | 1.00 | 0.00 |
| Polybutenylsuccinbisimide B: | 5.00 | 5.00 | 5.00 | 5.00 | 5.00 | 5.00 | 5.00 | 5.00 | 5.00 | 5.00 | 5.00 | 5.00 | 4.00 |
| Polybutenylsuccinmonoimide C | 0.00 | 0.00 | 0.00 | 0.00 | 0.00 | 0.00 | 0.00 | 0.00 | 0.00 | 0.00 | 0.00 | 0.00 | 2.00 |
| Viscosity index improving agent | 6.50 | 6.50 | 7.00 | 7.00 | 7.00 | 6.50 | 6.50 | 6.50 | 6.50 | 6.50 | 6.50 | 6.50 | 6.50 |
| Pour point depressant | 0.30 | 0.30 | 0.30 | 0.30 | 0.30 | 0.30 | 0.30 | 0.30 | 0.30 | 0.30 | 0.30 | 0.30 | 0.30 |
| Metal base detergent A | 2.82 | 2.82 | 0.00 | 0.00 | 0.00 | 2.82 | 2.82 | 2.82 | 2.82 | 2.82 | 2.82 | 2.82 | 2.82 |
| Metal base detergent B | 0.00 | 0.00 | 1.00 | 1.00 | 1.00 | 0.00 | 0.00 | 0.00 | 0.00 | 0.00 | 0.00 | 0.00 | 0.00 |
| Metal base detergent C | 0.00 | 0.00 | 0.60 | 0.60 | 0.60 | 0.00 | 0.00 | 0.00 | 0.00 | 0.00 | 0.00 | 0.00 | 0.00 |
| Phenol base antioxidant | 0.50 | 0.50 | 0.50 | 0.50 | 0.50 | 0.50 | 0.50 | 0.50 | 0.50 | 0.50 | 0.50 | 0.50 | 0.50 |
| Amine base antioxidant | 0.50 | 0.50 | 0.50 | 0.50 | 0.50 | 0.50 | 0.50 | 0.50 | 0.50 | 0.50 | 0.50 | 0.50 | 0.50 |
| Zinc dialkyldithiophosphate | 1.22 | 1.22 | 0.91 | 0.61 | 0.61 | 1.22 | 1.22 | 1.22 | 1.22 | 1.22 | 1.22 | 1.22 | 1.22 |
| Others | 0.50 | 0.50 | 0.50 | 0.50 | 0.50 | 0.50 | 0.50 | 0.50 | 0.50 | 0.50 | 0.50 | 0.50 | 0.50 |

TABLE 2

| | | Example | | | | | Comparative Example | |
|---|---|---|---|---|---|---|---|---|
| | | 1 | 2 | 3 | 4 | 5 | 1 | 2 |
| Property | Phosphorus content (mass %) | 0.10 | 0.10 | 0.08 | 0.05 | 0.05 | 0.10 | 0.10 |
| | Sulfur content (mass %) | 0.22 | 0.22 | 0.20 | 0.15 | 0.15 | 0.22 | 0.22 |
| | Nitrogen content (mass %) | 0.07 | 0.07 | 0.07 | 0.07 | 0.07 | 0.07 | 0.07 |
| | Bisimide content (mass %) | 83 | 83 | 83 | 83 | 83 | 83 | 83 |

TABLE 2-continued

| | | | | | | | | |
|---|---|---|---|---|---|---|---|---|
| | Bisimide (N) content (mass %) | 74 | 74 | 74 | 74 | 74 | 74 | 74 |
| | Sulfated ash content (mass %) | 1.0 | 1.0 | 0.6 | 0.5 | 0.5 | 1.0 | 1.0 |
| Reciprocating friction test | Chromium plating treatment test ball | 0.133 | 0.119 | 0.130 | 0.128 | 0.121 | 0.178 | 0.163 |
| Upper column: friction coefficient | | 25.3 | 33.1 | 27.0 | 28.1 | 32.0 | 0 | 8.4 |
| | Nitride treatment test ball | 0.135 | 0.125 | 0.137 | 0.135 | 0.131 | 0.186 | 0.171 |
| | | 27.4 | 32.8 | 26.1 | 27.4 | 29.6 | 0 | 7.8 |
| | PVD/CrN treatment test ball | 0.127 | 0.115 | 0.125 | 0.123 | 0.117 | 0.173 | 0.158 |
| Lower column: friction coefficient | | 26.6 | 33.5 | 27.8 | 28.7 | 32.4 | 0 | 8.6 |
| | DLC (hydrogen 20%) treatment test ball | 0.121 | 0.115 | 0.120 | 0.120 | 0.118 | 0.155 | 0.144 |
| | | 21.9 | 25.8 | 22.3 | 22.4 | 23.9 | 0 | 6.8 |
| reducing rate (%) | | | | | | | | |
| Oxidative deterioration test | Kinematic viscosity ratio (40° C.) | 1.36 | 1.51 | 1.38 | 1.40 | 1.45 | 1.21 | 1.25 |
| | Cu (ppm) | 91 | 99 | 88 | 76 | 102 | 38 | 52 |
| Lead corrosion test: | Pb (ppm) | 46 | 106 | 51 | 48 | 63 | 21 | 12 |

| | | Comparative Example | | | | | |
|---|---|---|---|---|---|---|---|
| | | 3 | 4 | 5 | 6 | 7 | 8 |
| Property | Phosphorus content (mass %) | 0.10 | 0.10 | 0.10 | 0.10 | 0.10 | 0.10 |
| | Sulfur content (mass %) | 0.22 | 0.22 | 0.22 | 0.22 | 0.22 | 0.22 |
| | Nitrogen content (mass %) | 0.07 | 0.07 | 0.07 | 0.07 | 0.07 | 0.08 |
| | Bisimide content (mass %) | 83 | 83 | 83 | 83 | 83 | 67 |
| | Bisimide (N) content (mass %) | 74 | 74 | 74 | 74 | 74 | 49 |
| | Sulfated ash content (mass %) | 1.0 | 1.0 | 1.0 | 1.0 | 1.0 | 1.0 |
| Reciprocating friction test | Chromium plating treatment test ball | 0.150 | 0.162 | 0.148 | 0.118 | 0.120 | 0.132 |
| Upper column: friction coefficient | | 15.7 | 9.0 | 16.9 | 33.7 | 32.6 | 25.8 |
| | Nitride treatment test ball | 0.158 | 0.170 | 0.157 | 0.127 | 0.127 | 0.140 |
| | | 14.9 | 8.4 | 15.8 | 31.8 | 31.8 | 25.0 |
| | PVD/CrN treatment test ball | 0.146 | 0.158 | 0.143 | 0.114 | 0.116 | 0.128 |
| Lower column: friction coefficient | | 15.6 | 8.8 | 17.2 | 34.1 | 32.9 | 26.1 |
| | DLC (hydrogen 20%) treatment test ball | 0.135 | 0.143 | 0.133 | 0.111 | 0.113 | 0.122 |
| | | 12.8 | 7.5 | 14.4 | 28.1 | 27.1 | 21.2 |
| reducing rate (%) | | | | | | | |
| Oxidative deterioration test | Kinematic viscosity ratio (40° C.) | 1.32 | 1.24 | 1.34 | 2.00 | 1.55 | 1.82 |
| | Cu (ppm) | 74 | 48 | 82 | 250 | 219 | 139 |
| Lead corrosion test: | Pb (ppm) | 12 | 26 | 38 | 710 | 516 | 372 |

In the chromium plating treatment test ball, the friction coefficient reducing rate shows a high value of 25% or more in the examples, and an effect of reducing a friction coefficient is shown in the lubricating oil composition of the present invention. It is suggested in Example 1 and Comparative Examples 2 to 5 that the above effect is provided by a synergistic effect of the component (A) and the component (B). The same tendency is observed as well in the test ball subjected to nitride treatment, chromium nitride (PVD) treatment or DLC (containing hydrogen 20%) treatment.

A relation of the contents of the component (A) and the component (B) with the friction coefficient reducing effect is found from the results shown in Examples 1 to 2 and Comparative Example 6. An effect meeting the addition amount is not obtained in Comparative Example 6 as compared with Examples 1 to 2. Further, in Comparative Example 6, high values are shown in the oxidative deterioration test and the lead corrosion test of the lubricating oil composition, and a negative effect brought about by adding the component (A) and the component (B) results in being markedly shown.

Also, as shown in Example 2 and Comparative Example 7, inhibition of the oxidative deterioration and the lead corrosion is further achieved by adding the benzotriazole compound (C).

Further, comparison of Examples 1 to 5 with Comparative Example 8 shows that the results obtained in Comparative Example 8 are inferior to a large extent in the lead corrosion test and the oxidative deterioration test. This is considered to originate in a difference of the imide compounds, and the above effect is obtained by a regulated content of the polybutenylsuccinbisimide compound (d1) containing a polybutenyl group having a number average molecular weight of 1,500 or more based on a whole amount of the succinimide compound (D) and a regulated nitrogen content of the component (d1) based on a whole nitrogen amount of the succinimide compound (D).

As shown above, the present invention has been completed by making use of an excellent friction reducing effect obtained by a synergistic effect of the component (A) and the component (B) and inhibiting the negative effects such as oxidative deterioration and lead corrosion which are brought about by using them in combination by numerical limitation in the contents of the component (A) and the component (B) and addition of the specific benzotriazole derivative (C) and the specific succinimide compound (D).

INDUSTRIAL APPLICABILITY

The lubricating oil composition of the present invention for internal combustion engines is an environmental regulation compliant type which is reduced in ash, phosphorus and sulfur and which is improved in a friction reducing effect, an oxidation stability and a corrosion inhibiting effect, and it is used for internal combustion engines such as gasoline engines, diesel engines, engines using dimethyl ether for fuel, gas engines and the like.

What is claimed is:

1. A lubricating oil composition comprising a base oil for a lubricating oil, (A) a fatty acid partial ester compound, (B) at least one compound selected from the group consisting of (b1) an aliphatic amine compound and (b2) an acid amide compound, (C) a benzotriazole derivative represented by Formula (I):

(I)

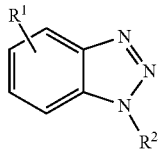

wherein in Formula (I), $R^1$ and $R^2$ each are independently a hydrocarbyl group having 1 to 20 carbon atoms which may comprise an oxygen atom, a sulfur atom or a nitrogen atom, and (D) a succinimide compound which is represented by Formula (II) or Formula (III):

(II)

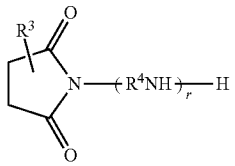

(III)

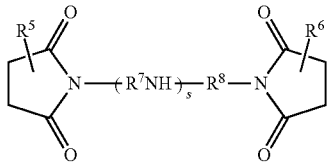

wherein $R^3$, $R^5$ and $R^6$ are an alkenyl group or an alkyl group each having a number average molecular weight of 500 to 3,000, and $R^5$ and $R^6$ may be the same or different; $R^4$, $R^7$ and $R^8$ each are an alkylene group having 2 to 5 carbon atoms, and $R^7$ and $R^8$ may be the same or different; r represents an integer of 1 to 10; and s represents 0 or an integer of 1 to 10; and in which (d1) a polybutenylsuccinbisimide compound comprising a polybutenyl group having a number average molecular weight of 1,500 or more accounts for 70% by mass or more based on the whole amount of (D), the lubricating oil composition comprising 0.01 to 0.1% by mass of the component (C) and 0.5 to 15% by mass of the component (D), wherein the blending amount of the component (A) is 0.05% by mass or more, and the blending amount of the component (B) is 0.05% by mass or more, and the total amount of component (A) and component (B) is from 0.5 to 1.5% by mass, based on the lubricating oil composition;

wherein the component (A) is a partial ester obtained by reacting aliphatic polyhydric alcohol with fatty acid having a linear or branched hydrocarbon group having 6 to 30 carbon atoms;

wherein the component (b1) is an amine compound having a linear or branched hydrocarbon group having 6 to 30 carbon atoms;

wherein the component (b2) is oleic acid monoethanolamide, oleic acid diethanolamide, oleic acid monopropanolamide, oleic acid dipropanolamide, or mixture thereof.

2. The lubricating oil composition according to claim 1, wherein the composition comprises 0.3% by mass or less of sulfur, based on the composition.

3. The lubricating oil composition according to claim 1, wherein the composition comprises 0.12% by mass or less of phosphorous, based on the composition.

4. The lubricating oil composition according to claim 1, wherein the composition comprises 1% by mass or less of sulfated ash, based on the composition.

5. An engine comprising piston rings which are subjected to at least one surface treatment of chromium plating, gas nitriding, chromium nitride or diamond-like carbon treating, wherein said engine comprises the lubricating oil composition according to claim 1.

6. An engine comprising the lubricating oil composition according to claim 1 and a cylinder liner comprising cast iron or boron cast iron.

7. The lubricating oil composition according to claim 1, wherein the component (A) is glycerin monomyristate, glycerin monopalmitate, glycerin monooleate, glycerin dimyristate, glycerin dipalmitate, or glycerin dioleate.

8. The lubricating oil composition according to claim 1, wherein the component (b1) is an aliphatic monoamines or an alkylene oxide adduct thereof, an alkanolamine, an aliphatic polyamine, an imidazoline compound, or mixtures thereof.

9. The lubricating oil composition according to claim 1, wherein the total amount of component (A) and component (B) is from 0.6 to 1.2% by mass, based on the lubricating oil composition.

10. The lubricating oil composition according to claim 1, wherein in Formula (III), s is preferably 1 to 4.

11. The lubricating oil composition according to claim 1, wherein the lubricating oil composition further comprises a viscosity index improving agent, a pour point depressant, a metal base detergent, an antioxidant, a wear resistant agent, an extreme pressure agent, a friction reducing agent other than the component (A) and the component (B) described above, a rust preventive, a surfactant, an emulsification resistant agent, or a defoaming agent, or mixtures thereof.

12. The lubricating oil composition according to claim 1, wherein the lubricating oil composition comprises a viscosity index improving agent selected from the group consisting of a polymethacrylate, a dispersion type polymethacrylate, an olefin base copolymer, a dispersion olefin base copolymer, and a styrene base copolymer.

13. The lubricating oil composition according to claim 1, wherein the lubricating oil composition comprises a metal base detergent selected from the group consisting of an alkaline earth metal sulfonate, an alkaline earth metal phenate, an alkaline earth metal salycilate and mixtures of two or more compounds selected from the above compounds.

14. The lubricating oil composition according to claim 1, wherein the lubricating oil composition comprises an antioxidant selected from the group consisting of a phenol bases antioxidant, an amine based antioxidant, a molybdenum amine complex based antioxidant, and a sulfur based antioxidant.

15. The lubricating oil composition according to claim 1, wherein the lubricating oil composition comprises a surfactant or an emulsification resistant agent selected from the group consisting of a polyoxyethylene alkyl ether, a polyoxyethylene alkylphenyl ether, and a polyoxyethylene alkylnaphthyl ether.

16. The lubricating oil composition according to claim 1, wherein component (A) is glycerin monooleate.

17. The lubricating oil composition according to claim 1, wherein component (B) is oleic diethanolamide.

18. The lubricating oil composition according to claim 1, wherein component (C) is 1-[N,N-bis(2-ethylhexy)aminomethyl]methylbenzotriazole.

* * * * *